US005730047A

United States Patent [19]

Lindsey

[11] Patent Number: 5,730,047

[45] Date of Patent: Mar. 24, 1998

[54] PORTABLE REFUSE COMPACTING CONTAINER

[76] Inventor: H. Wayne Lindsey, Rt. 1, Box 349, Okolona, Ark. 71962

[21] Appl. No.: 701,075

[22] Filed: Aug. 21, 1996

[51] Int. Cl.[6] ..... B30B 9/30; B30B 9/06

[52] U.S. Cl. ..... 100/90; 100/100; 100/116; 100/125; 100/219; 100/227; 100/240; 100/293

[58] Field of Search ..... 100/90, 100, 116, 100/125, 132, 219, 226–228, 240, 245, 293

[56] References Cited

U.S. PATENT DOCUMENTS

| | | | |
|---|---|---|---|
| D. 318,351 | 7/1991 | Wilson . | |
| 630,669 | 8/1899 | Dale et al. | 100/227 |
| 1,142,704 | 6/1915 | Haugh | 100/293 |
| 1,250,558 | 12/1917 | Burns | 100/293 |
| 3,438,322 | 4/1969 | Marasco . | |
| 3,835,769 | 9/1974 | Peterson . | |
| 3,850,094 | 11/1974 | Shontz | 100/226 |
| 4,331,074 | 5/1982 | Behman . | |
| 4,333,396 | 6/1982 | Longnecker . | |
| 4,442,768 | 4/1984 | Bailey . | |
| 4,593,615 | 6/1986 | Kehl . | |
| 4,629,233 | 12/1986 | Pfisterer . | |
| 4,898,304 | 2/1990 | Bacon, Jr. . | |
| 4,971,274 | 11/1990 | Mitchell . | |
| 4,991,500 | 2/1991 | Knapp . | |
| 5,009,155 | 4/1991 | Christianson . | |
| 5,203,262 | 4/1993 | Menard et al. . | |

FOREIGN PATENT DOCUMENTS

| | | | |
|---|---|---|---|
| 2843009 | 4/1980 | Germany | 100/240 |
| 8501293 | 12/1986 | Netherlands | 100/227 |

*Primary Examiner*—Stephen F. Gerrity
*Attorney, Agent, or Firm*—Ray F. Cox, Jr.

[57] ABSTRACT

A portable refuse compacting container including a container for receiving a flexible refuse collection bag of the type typically known as garbage bags or leaf bags. Bulky refuse such as leaves, grass clippings and the like may be placed in the refuse collection bag where these materials are compressed by a compacting plate which is loosely received inside the container. The compacting plate is used to compress the refuse by an attached plunger arm which is affixed to the compacting plate and which is pivotally attached to a compaction lever. The compaction lever is pivotally attached to the edge of the top of the container. The compaction lever may be latched in place on the container. The container is provided with wheels for ease in moving either the full or the empty container from place to place. When the compaction lever is latched to the container, the handle of the compaction lever also serves as a handle for moving the container about on its wheels.

5 Claims, 3 Drawing Sheets

FIG. 7B
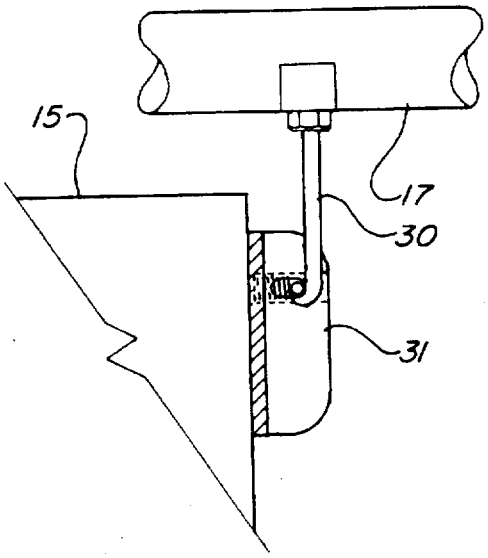
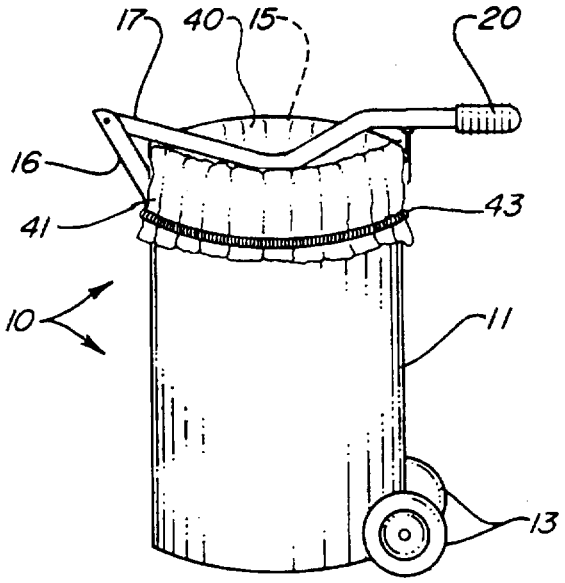
FIG. 9
FIG. 7C
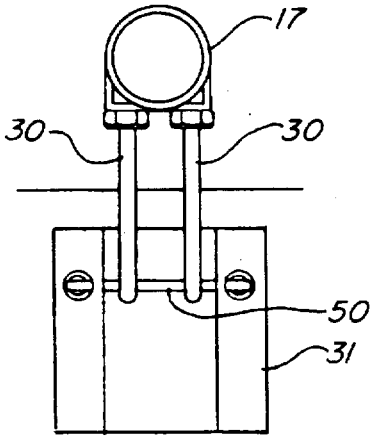
FIG. 8A
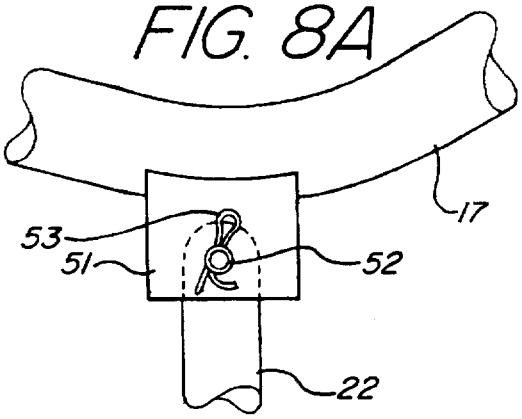
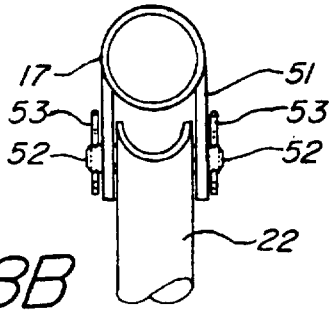
FIG. 8B

PORTABLE REFUSE COMPACTING CONTAINER

BACKGROUND OF THE INVENTION

The present invention relates to a device for bagging and compacting compressible refuse, such as leaves, grass clippings and similar yard or garden debris.

The disposal of garbage, trash, refuse and the like present problems in compactly storing, containing or disposing of materials that tend to be inherently bulky and of low density. For example, it is recognized that discarded beverage containers and the like can advantageously be crushed to reduce the total space occupied by the discarded containers which simplifies collecting, storing and disposing of such materials. Numerous examples of devices for crushing cans are known in the art. A partial list would include U.S. Pat. No. 5,203,262, U.S. Pat. No. 5,009,155, U.S. Pat. No. 4,442,768, U.S. Pat. No. 4,333,396. In general, these devices employ some form of pivoted lever arm for applying pressure to the cans so as to crush and reduce the bulk of the cans.

Similar devices have been employed in other arts for applying mechanical leverage. See, for example, U.S. Pat. No. 4,898,304 issued to Bacon, Jr. on Feb. 6, 1990 for "Viscous Liquid Dispenser."

Waste compaction principles have been applied to garbage and trash receptacles. U.S. Pat. No. 4,593,615 issued to Kehl on Jun. 10, 1986 discloses a trash receptacle having a top which can be released from pivotal engagement with the frame of the container such that the top can be pushed downwardly into the interior cavity of the container by the user for compacting trash material therein. A similar concept involving a cover which is also useable as a compaction device is disclosed in U.S. Pat. No. 4,331,040 issued to Behman on May 25, 1982 for "Cover and Compacting Assembly for Trash Cans." A variation on this idea is disclosed in U.S. Pat. No. 3,835,769 issued to Peterson on Sep. 17, 1974 for "Refuse Compactor." Peterson discloses a refuse container having a bellows and pressure plate for compacting refuse contained therein.

The bagging of leaves, grass clippings and similar lawn and garden debris presents a particularly difficult problem due to the low density and bulkiness of such material. One solution to the problem of disposing of leaves, grass and the like is disclosed in U.S. Pat. No. 4,629,233 issued to Pfisterer on Dec. 16, 1986 for "Material Compacting Device." Pfisterer discloses a funnel with a rake and plunger element for forcing material into a tubular netted bag.

Since modern practice is to employ disposable refuse collection bags which are typically made of strong but lightweight plastic materials, it is desirable to provide for the collection and compaction of leaves, grass clippings and the like in conjunction with the use of such refuse collection bags. U.S. Pat. No. 4,971,274 issued to Mitchell on Nov. 20, 1990 for "Combination Holder for Disposable Leaf and Rubbage Bags and Yard Tool" discloses a holder for maintaining the mouth of a plastic garbage or leaf bag in an open position for collecting and bagging leaves for disposal.

U.S. Pat. No. 4,991,500 issued to Knapp on Feb. 12, 1991 discloses a device for holding a trash bag with an end folded over the top end of a container. Trash is received in the trash bag and a compactor plate received within the container allows the manual compaction of the materials held in the trash bag. The housing has ventilation apertures in its sidewall and bottom to allow air trapped between the bag and the sidewalls of the housing to be expelled from the container.

U.S. Pat. No. 3,438,322 issued to Marasco on Apr. 15, 1969 for "Refuse Press" discloses a framework to be used in conjunction with a container holding a disposable refuse bag. Material placed in the refuse bag is directed therein by a funnel arrangement. A compression structure attached to the framework includes a plunger and piston which fits loosely within the container. The compressor structure includes a lever pivotally connected to the frame to move the plunger and piston so as to compact refuse placed in the collection bag. Marasco also discloses a clamping hoop for clamping the top of the disposable refuse bag to the container.

It has been recognized that it is desirable to provide for trash, garbage or refuse containers which may be fitted with wheels for ease of movement. An example is shown in U.S. Design Pat. No. 318,351 issued to Wilson on Jul. 16, 1991.

The prior art has not yet succeeded in combining a compaction apparatus for leaves, lawn and garden debris and the like for use in conjunction with disposable refuse collection bags and which also combines the desirable feature of ease of mobility.

SUMMARY OF THE INVENTION

The disadvantages and limitations of the prior art have been overcome by the portable refuse compacting container of the present invention. The present invention includes a container for receiving a flexible refuse collection bag of the type typically known as garbage bags or leaf bags. These bags are constructed of strong, lightweight plastic materials. Bulky refuse such as leaves, grass clippings and the like may be placed in the refuse collection bag where these materials are compressed by a compacting plate which is loosely received inside the container. The compacting plate is used to compress the refuse by means of an attached plunger arm which is affixed to the compacting plate and which is pivotally attached to a compaction lever. The compaction lever is pivotally attached to the edge of the top of the container. By manual operation of the compaction lever, the plunger arm forces the compaction plate down into the refuse thereby compacting it to a greater density and allowing more material to be placed in the refuse collection bag.

The compaction lever may be latched in place on the container. The container is provided with wheels for ease in moving either the full or the empty container from place to place. When the compaction lever is latched to the container, the handle of the compaction lever also serves as a handle for moving the container about on its wheels. The handle of the compaction lever thus serves two purposes and serves to reduce the part count and complexity of the device.

The compacting plate and the container may be provided with openings to allow the escape of trapped air or liquids in the compacted refuse.

When a flexible refuse collection bag is placed in the container, it may be secured by folding the upper edge of the bag over the top edge of the container. However, to provide more effective securing of the refuse collection bag to the container, the present invention provides for two alternatives. In one embodiment a plurality of clips are disposed around the top edge of the container for securing the folded upper edge of the refuse collection bag. In the preferred embodiment, an endless spring is disposed about the top edge of the container. Once the upper edge of the refuse collection bag is folded over the top edge of the container, the endless spring may be rolled up and over the folded edge so as to secure the folded edge to the container.

It is, therefore, an object of the present invention to provide for a refuse container for receiving bulky refuse, such as leaves, grass clippings and the like, and which provides means for compaction of such bulky refuse in order to improve the efficiency of collection, storage and disposal of such refuse.

It is a further object of the present invention to provide for such a refuse container which is easily portable in either a filled or empty condition, and, in particular, for a refuse container which is provided with wheels for mobility.

It is an additional object of the present invention to provide for a portable refuse compacting container which operates by means of a manually operated lever arm acting through a compacting plate for compacting bulky refuse.

It is a still further object of the present invention to provide for a portable refuse compacting container in which a pivoted lever arm for compacting the refuse also serves as a handle to assist in the mobility of the portable container through a latching mechanism.

Further objects and advantages of the present invention will be apparent through a consideration of the detailed description of the preferred embodiments in conjunction with the appended drawings as described below.

BRIEF DESCRIPTION OF THE DRAWINGS

FIG. 7B is a left side elevation detail of the latch.

FIG. 7C is front elevation detail of the latch.

FIG. 8A is a left side elevation detail of the pivot for the plunger arm.

FIG. 8B is a front elevation detail of the pivot for the plunger arm.

FIG. 9 is a left side elevation showing an endless spring for holding a refuse collection bag in the container.

DETAILED DESCRIPTION OF THE PREFERRED EMBODIMENTS

Figures 1, 2, 3:
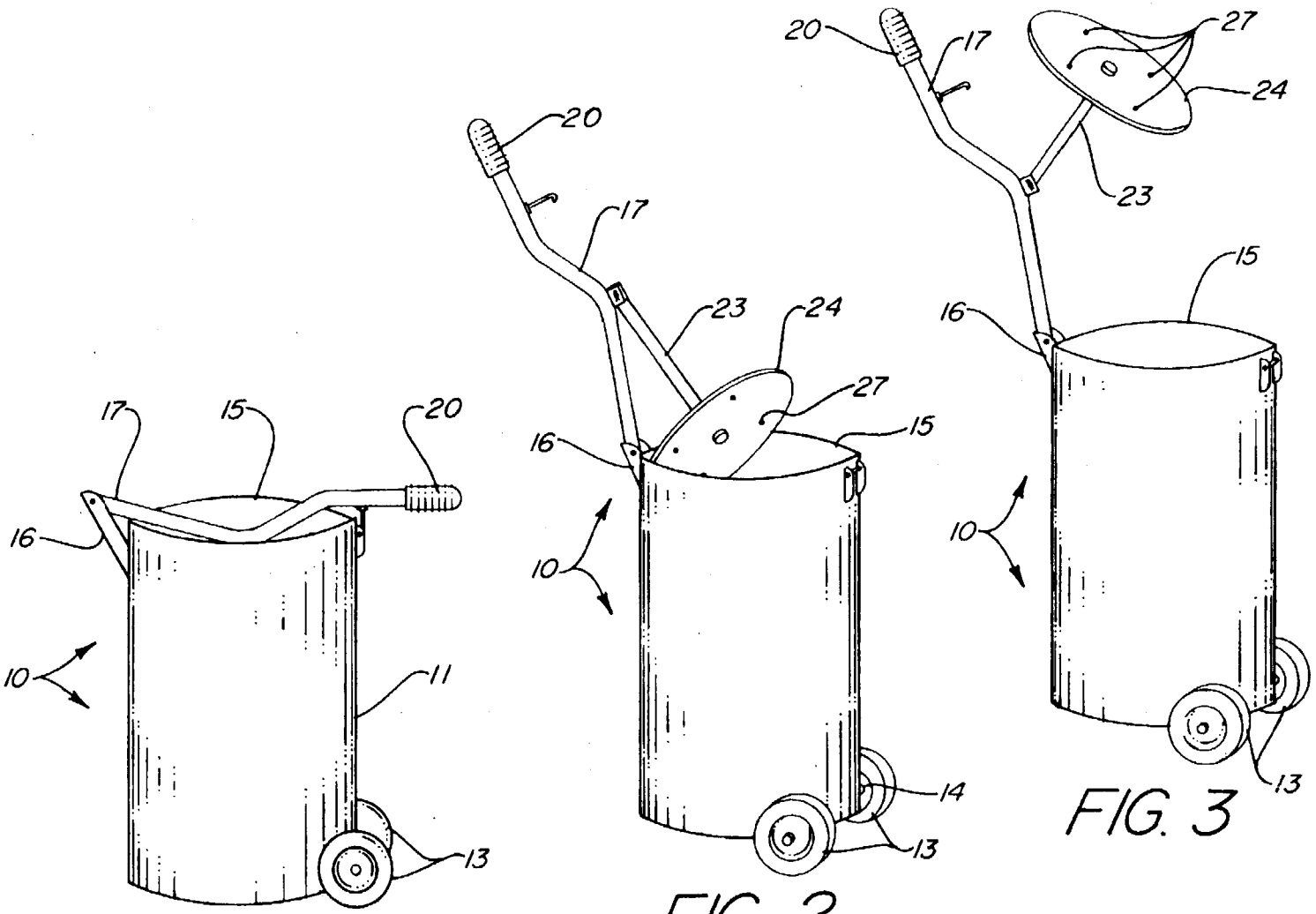
FIG. 1 is a left side elevation of the portable refuse compacting container with the lever arm in the down and latched position.
FIG. 2 is a perspective view of the portable refuse compacting container with the compacting plate shown at the beginning of the compaction cycle.
FIG. 3 is a perspective view of the portable refuse compacting container showing the compacting plate completely retracted from the container.

The general appearance of the present invention may be described with reference to FIGS. 1, 2 and 3. A container 10 having enclosed sides 11 and a bottom 12 and an open top forms an enclosure for receiving compressible refuse such as leaves, grass clippings and the like. The container 10 is provided with wheels 13 for ease of movement. The wheels 13 may advantageously be grouped in pairs having a common axle 14.

The container 10 has a top edge 15 surrounding the open top of the container 10. A pivot attachment 16 is cantilevered upward and outward from the top edge 15 of the container 10. A compaction lever 17 is pivotally attached at a first end 18 to the pivot attachment 16. A second end 19 of the lever 17 is formed into a handle 20.

Figure 5:
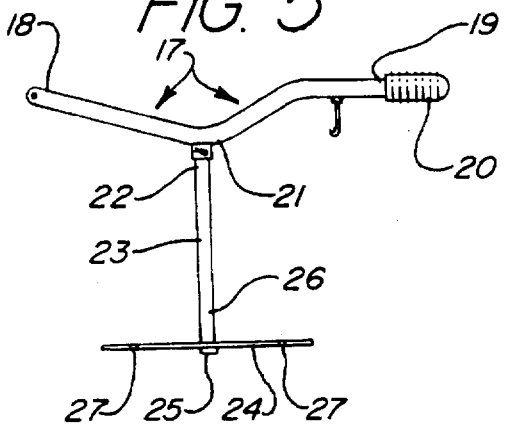
FIG. 5 is a left side elevation detail of the compaction lever, plunger arm and compaction plate.

As shown in FIG. 5, the lever 17 is preferably formed with a broadly obtuse downward pointing angle. Although not necessary for the practice of the invention, this angle in the preferred embodiment assures clearance of the plunger arm 23 and compacting plate 24 over the side of the container 10 while also assuring that the plunger arm 23 depresses the compacting plate 24 into the container 10 to the optimum level to obtain good compaction of the refuse. At the apex 21 of this downward pointing obtuse angle, a second end 22 of a plunger arm 23 is pivotally attached to the lever 17. A compacting plate 24 is affixed at its center 25 to the second end 26 of the plunger arm 23. The plunger arm 23 is pivotally attached to the lever 17 by a pivot means as shown in detail in FIGS. 8A and 8B. A bracket 51 affixed to the lever 17 receives a bushing 52 which pivotally secures the second end 22 of the plunger arm 23. The bushing 52 is secured to the bracket 51 by means such as cotter pins 53.

The compacting plate 24 may be provided with a plurality of ventilating openings 27 in order to allow the escape of trapped air and liquids as will be described more fully hereinafter.

Figure 4:
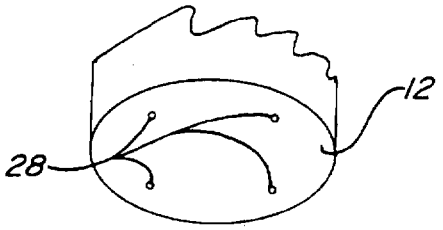
FIG. 4 is a bottom view of the container showing ventilating openings.

With reference to FIG. 4, the container 10 may be provided with a plurality of openings 28 through the bottom 12 so as to facilitate the draining of trapped air or liquids from the container 10.

The container 10 may be used for receiving and compacting compressible refuse such as leaves, grass clippings and the like. The operation of the present invention may be described with reference to FIGS. 1, 2, 3 and 6. The lever 17, plunger arm 23 and compacting plate 24 are shown in a sequence of phantom views in FIG. 6. As may be seen from FIG. 3 when the lever 17 is pivoted upward and outward away from the container 10, the compacting plate 24 and plunger arm 23 may be pivoted backwards so as to completely clear the open top of the container 10 to facilitate placing refuse in the container 10. After a quantity of refuse is placed in the container 10, the compaction process may begin by lowering the compacting plate 24 to the position shown in FIG. 2 which is equivalent to the first position shown in FIG. 6. The compacting plate 24 enters the open top of the container 10, at which point manual operation of the lever 17 by means of the handle 20 forces the compacting plate 24 down on to the refuse in the container 10. As may be seen from the succeeding phantom views in FIG. 6, the compacting plate 24 proceeds downward through the container 10 compressing the refuse ahead of the compacting plate 24 until the refuse is compacted to some fraction of its former volume. As mentioned above, air trapped in the compacted refuse may be released through a number of ventilating openings 27 in the compacting plate 24. Likewise, openings 28 may be provided in the bottom 12 of the enclosure 10 to facilitate the release of trapped air or to drain trapped liquids.

Once the lever has been brought to the lowermost position such that the lever 17 is resting on the top edge 15 of the container 10, the process may be reversed until the compacting plate 24 has once again assumed the position shown in FIG. 3. At this point additional refuse may be added to the container 10 and the compacting process repeated as many times as desirable.

Figure 7A:
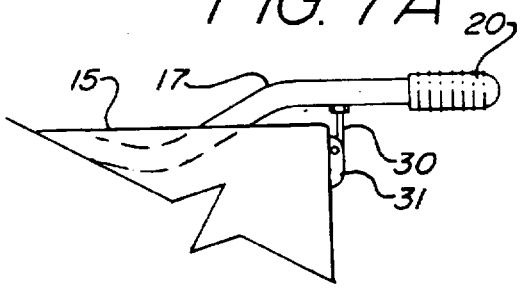
FIG. 7A is a left side elevation of the latch.

Once the container 10 has been filled to maximum capacity with compressed refuse, the lever 17 may be lowered to the position shown in FIG. 1. As shown in detail on FIGS. 7A, 7B, and 7C, the lever 17 is provided with a catch 30 which engages with a latching mechanism 31 located in proximity to the top edge 15 of the container 10. By this mechanism the lever 17 may be locked to the position shown in FIG. 1. The handle 20 which heretofore has been used to mechanical advantage in the compression of the refuse now becomes a handle for maneuvering the container 10 on the wheels 13. The handle 20 may be used to tip the container 10 backwards onto the wheels 13 whereby the container 10 may easily be maneuvered on the wheels 13.

The catch 30 in the preferred embodiment is a J-shaped hook. The latching mechanism 31 includes a spring loaded bar 50 which catches and locks the J-shaped hook of the catch 30. A pair of J-shaped hooks threadedly secured to the lever 17 may advantageously be employed to more fully latch the lever 17. The latching mechanism is easily released by pressure on the spring loaded bar 50.

Figure 6:
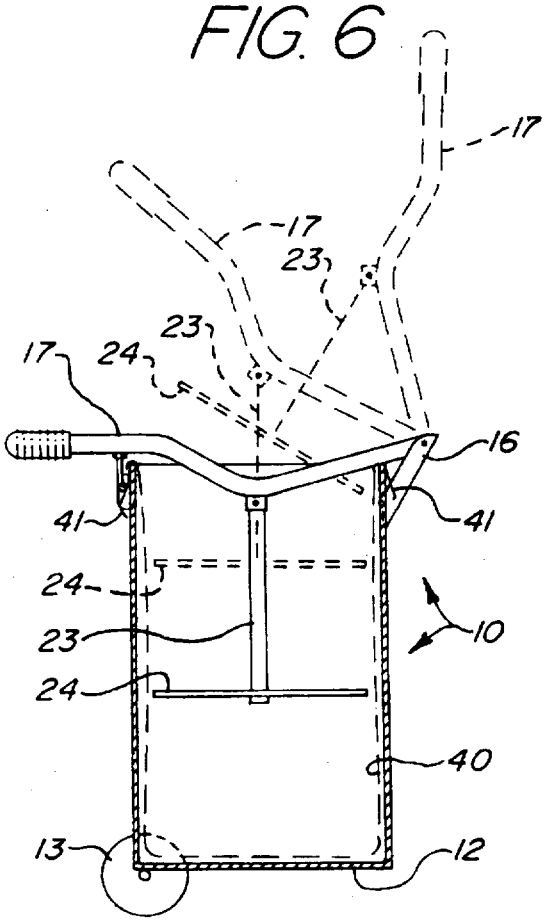
FIG. 6 is a right side elevation view of the portable refuse compacting container showing various stages in the compaction process.

An alternative embodiment of the present invention is shown in FIG. 6 where the wheels 13 are located on the opposite side of the container 10 from the handle 20. This arrangement may be convenient if the container 10 is to be pulled by the handle 20 rather than pushed.

The present invention may be used as described above or may also be used with a flexible refuse collection bag of the type commonly known as leaf bags. A leaf bag 40 may be disposed in a nested fashion inside the container 10 as shown in FIG. 6. The upper edge 41 of the leaf bag 40 may be folded over the top edge 15 of the container 10. It is desirable to secure the upper edge 41 of the leaf bag 40 before filling the leaf bag 40 with refuse and compressing the refuse. One means of securing the upper edge 41 of the leaf bag 40 may be by means of a plurality of clips arrayed about the top edge 15 of the container 10.

The preferred means of securing the upper edge 41 of the leaf bag 40 is shown in FIG. 8. In this alternative embodiment, an endless spring 43 is disposed about the container 10. After the upper edge 41 of the leaf bag 40 is folded over the top edge 15 of the container 10, the endless spring 43 may be rolled upward over the upper edge 41 of the leaf bag 40, thereby securing the upper edge 41 in position. In order to remove the leaf bag 40, the spring 43 is rolled downward until the upper edge 41 is released.

When a leaf bag 40 is used in conjunction with the present invention, the sequence of compression of refuse is identical to the sequence disclosed above. Once the leaf bag 40 is full, the top may be secured and it may then be removed from the container 10 for disposal or further handling.

The present invention is shown with a container 10 that is essentially an open topped cylinder. The compacting plate 24 is thus in the form of a flat circular plate which fits loosely inside the cylindrical shape of the container 10. It should be understood that other shapes of the container 10 and the compacting plate 24 would be acceptable for the practice of the present invention.

The present invention has been described with respect to certain preferred and alternative embodiments which are considered to be exemplary only and not limiting to the full scope of the invention as set forth in the appended claims.

What is claimed is:

1. A portable refuse compacting container, comprising:

a container for receiving refuse;

wheels mounted to said container for wheeled movement of said container;

a compacting plate loosely received in said container and adapted to compress refuse received in said container;

a compaction lever having a first end hinged to the top edge of said container and having a second end on which a handle is disposed for manual compaction of refuse received in said container;

a plunger arm having a first end affixed to said compacting plate and a second end pivotally attached to said compaction lever;

means for latching said compaction lever to said container whereby said handle may be used to assist in wheeled movement of said container; and means for securing the upper edge of a flexible refuse collection bag to said top edge of said container;

wherein the flexible refuse collection bag is received within said container in nested relationship with said container and said upper edge of said flexible refuse collection bag is folded over said top edge of said container, said means for securing comprising an endless spring disposed about said top edge of said container.

2. The portable refuse compacting container of claim 1 wherein said compacting plate further comprises one or more openings for release of air or liquid trapped in refuse received in said container.

3. The portable refuse compacting container of claim 2 wherein said container further comprises a bottom having one or more openings for release of air or liquid trapped in refuse received in said container.

4. The portable refuse compacting container of claim 3 wherein said wheels are disposed substantially beneath said handle.

5. The portable refuse compacting container of claim 3 where said wheels are disposed substantially beneath said first end of said compaction lever.

* * * * *